US007421983B1

(12) United States Patent
Taylor

(10) Patent No.: US 7,421,983 B1
(45) Date of Patent: Sep. 9, 2008

(54) MARINE PROPULSION SYSTEM HAVING A COOLING SYSTEM THAT UTILIZES NUCLEATE BOILING

(75) Inventor: Christopher J. Taylor, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/728,530

(22) Filed: Mar. 26, 2007

(51) Int. Cl.
*F01P 9/00* (2006.01)
*F01P 3/00* (2006.01)

(52) U.S. Cl. ..... 123/41.01; 123/41.29

(58) Field of Classification Search ..... 123/41.44, 123/41.29, 41.01, 25 Q
See application file for complete search history.

(56) References Cited

U.S. PATENT DOCUMENTS 4,531,900 A 7/1985 Jones et al. ..... 418/61 A
4,768,484 A * 9/1988 Scarselletta ..... 123/41.21
5,309,885 A * 5/1994 Rawlings et al. ..... 123/509
5,724,924 A * 3/1998 Michels ..... 123/41.12
6,520,125 B2 * 2/2003 Suzuki et al. ..... 123/41.1
6,748,906 B1 * 6/2004 White et al. ..... 123/41.01
6,955,141 B2 10/2005 Santanam et al. ..... 123/41.08
H2145 H 2/2006 Bennett ..... 428/131
7,028,763 B2 4/2006 Garner et al. ..... 165/133

* cited by examiner

*Primary Examiner*—Noah Kamen
(74) *Attorney, Agent, or Firm*—William D. Lanyi

(57) ABSTRACT

A cooling system for a marine propulsion device incorporates both a closed portion and an open portion. The closed portion is operated to encourage nucleate boiling and is provided with a pump and a valve in order to regulate the rate of flow of coolant through certain heat emitting regions of the engine. The pump can be an electric variable speed pump and the valve can be used to direct coolant through a heat exchanger or to bypass the coolant around the heat exchanger.

22 Claims, 4 Drawing Sheets

MARINE PROPULSION SYSTEM HAVING A COOLING SYSTEM THAT UTILIZES NUCLEATE BOILING

BACKGROUND OF THE INVENTION

1. Field of the Invention

The present invention is generally related to a cooling system for a marine propulsion device and, more particularly, to a cooling system that intentionally induces nucleate boiling within cooling jackets of heat emitting components.

2. Description of the Related Art

Those skilled in the art of cooling systems are aware of the increased heat flux that occurs when a liquid changes state to a gas. During the process of nucleate boiling, a significant increase in the heat flux, from a heat emitting component, can be used advantageously in cooling systems.

U.S. Pat. No. 4,531,900, which issued to Jones et al. on Jul. 30, 1985, describes a rotary engine cooling system. A rotary engine has a substantially trochoidal-shaped housing cavity in which a rotor planetates. A cooling system for the engine directs coolant along a single series path consisting of series connected groups of passages. Coolant enters near the intake port, passes downwardly and axially through the cooler regions of the engine, then passes upwardly and axially through the hotter regions. By first flowing through the coolest regions, coolant pressure is reduced, thus reducing the saturation temperature of the coolant and thereby enhancing the nucleate boiling heat transfer mechanism which predominates in the high heat flux region of the engine during high power level operation.

U.S. Pat. No. 4,768,484, which issued to Scarselletta on Sep. 6, 1988, describes an actively pressurized engine cooling system. A coolant fluid is maintained in a state of nucleate boiling at a selected location in the coolant passages of an engine. The cooling system comprises a radiator and a coolant reservoir with a variable speed circulating pump for circulating the coolant through the coolant passages in the engine and through the radiator. A coolant pressure pump with a servo motor is adapted to pump coolant between the radiator and the reservoir as needed and to adjust the static pressure of the coolant.

U.S. Pat. No. 6,955,141, which issued to Santanam et al. on Oct. 18, 2005, describes an engine cooling system which has a diverter valve to selectively control the flow of coolant through an internal combustion engine having a cylinder block with a cooling jacket and a cylinder head mounted on the block with a cooling jacket. A controller, responsive to the temperature of the block and the head, controls the diverter valve and a water pump to provide adequate coolant flow through the head and the block as needed to maintain optimal operating temperatures. After the engine is shut off, the controller continues to operate the water pump and a cooling fan to continue to cool the engine for a period of time.

United States Statutory Invention Registration H2145, which was published on Feb. 7, 2006, describes mitigating ignition of fluids by hot surfaces. A platform, housing, conduit, exhaust duct or other structural element that encloses or supports a hot operating engine or other machinery is described wherein a pattern of micro-cavities is defined on the outer surface of the structure for mitigating ignition of a flammable liquid that comes into contact with the structure, the micro-cavities being sized to minimize seepage into the cavities of the liquid because of its surface tension, thereby preventing wetting of the interior of the cavities by the liquid.

U.S. Pat. No. 7,028,763, which issued to Garner et al. on Apr. 18, 2006, describes a cooling arrangement and method with selective surfaces configured to inhibit changes in boiling state. Heat transfer in coolant circuits, as in an internal combustion engine, for example, can be beneficially enhanced by maintaining the coolant in a nucleate boiling state, but undesirable transitions to a film boiling state are then possible. The coolant circuit has selected surfaces that have a tendency to experience high heat flux in comparison to adjacent surfaces in the cooling circuit. These surfaces are provided with a surface configuration, such as a matrix of nucleation cavities, which has a tendency to inhibit a change in the boiling state.

The patents described above are hereby expressly incorporated by reference in the description of the present invention.

It would be significantly beneficial if a marine propulsion system could be provided with a means for causing nucleate boiling to occur within the cooling jacket of an engine or within other heat emitting components of the marine propulsion system. More specifically, it would be beneficial if the cooling system that combines both closed loop and open loop portions could be provided with the benefits of nucleate boiling within the closed loop portion.

SUMMARY OF THE INVENTION

A method for cooling a marine propulsion system, in accordance with a preferred embodiment of the present invention, comprises the steps of providing an engine of the marine propulsion system, directing water, from a body of water, to flow in thermal communication with at least one component of the marine propulsion system, causing a coolant to flow in thermal communication with the engine, and controlling the flow of the coolant to cause the coolant to experience nucleate boiling when the temperature of the coolant is above the saturation point of the coolant.

The controlling step can comprise the steps of increasing the rate of flow when the temperature of the coolant is greater than a critical temperature of the coolant and decreasing the rate of flow when the temperature of the coolant is less than a saturation temperature of the coolant. Throughout the description of the preferred embodiment of the present invention, the boiling point of the coolant at the effective pressure of the coolant will be referred to as its saturation temperature and the temperature of the coolant at which transition boiling begins will be referred to as the critical temperature of the coolant. Both of these temperatures, between which nucleate boiling occurs, can be dynamically determined as a function of the effective pressure of the coolant or, in some applications of the present invention, can be predetermined as a function of other variables occurring in the operation of the engine. In other words, the effective pressure of the coolant can be indirectly determined by measuring other variables relating to the operation of the engine and inferring the effective pressure as a function of those variables based on empirically determined information relating to the particular type and size of engine and other characteristics of the marine propulsion system.

In some embodiments of the present invention, it can comprise the additional step of providing a heat exchanger to remove heat from the coolant. The heat exchanger, in a preferred embodiment of the present invention, is a water-to-water heat exchanger. The controlling step can comprise the steps of increasing the removal of heat from the coolant by the heat exchanger when the temperature of the coolant is greater than the critical temperature of the coolant and decreasing the removal of heat from the coolant by the heat exchanger when the temperature of the coolant is less than the saturation temperature of the coolant.

In certain embodiments of the present invention, a valve can be provided and connected in fluid communication between the engine and the heat exchanger. The controlling step could then comprise the steps of causing the valve to direct the flow of coolant through the heat exchanger when the temperature of the coolant is greater than a critical temperature of the coolant and causing the valve to bypass the heat exchanger when the temperature of the coolant is less than a saturation temperature of the coolant.

In a particularly preferred embodiment of the present invention, it comprises both a closed cooling portion and an open cooling portion. The coolant circulates through a closed portion of the cooling system which comprises a cooling jacket of the engine, a pump, the valve, and the heat exchanger. In certain embodiments of the present invention, the closed cooling system also comprises the exhaust manifold of the engine. The pump can be an electrical pump and, in a preferred embodiment of the present invention, is a variable speed pump.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
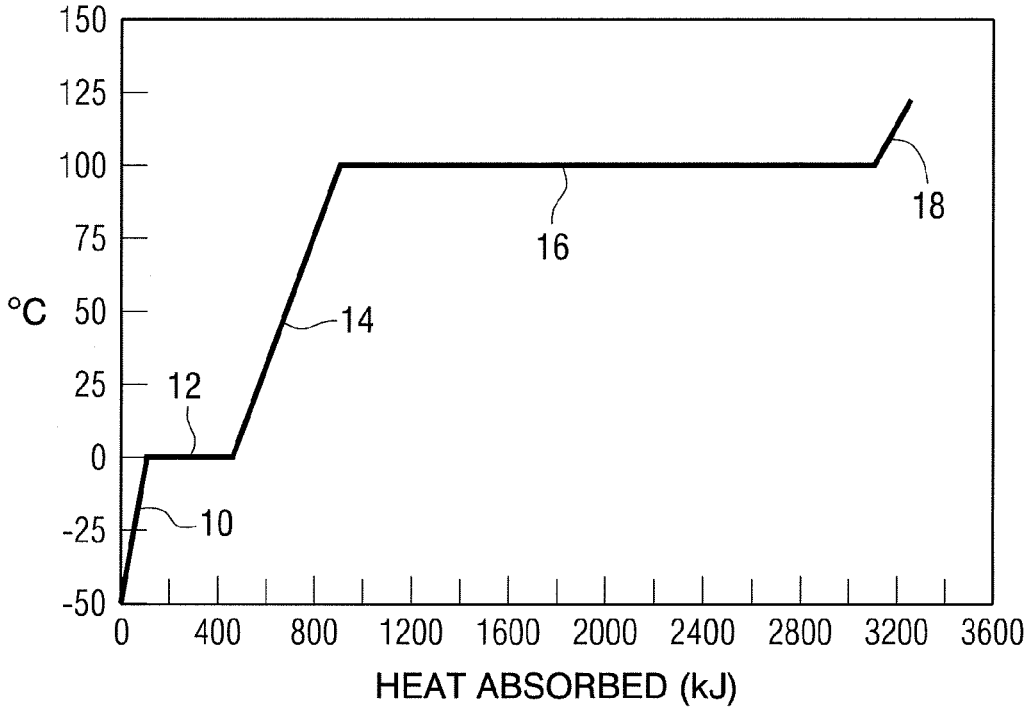
FIG. 1 is a graphical representation of the relationship between the temperature of a liquid and the heat absorbed by the liquid.

Throughout the description of the preferred embodiment of the present invention, like components will be identified by like reference numerals.

Known types of cooling systems for marine propulsion devices utilize traditional convective heat transfer to remove heat from various components of the engine through the circulation of liquid water that is drawn from a body of water, such as a lake or ocean. While the convective heat transfer found in typical marine propulsion systems is relatively efficient and serves the function as a mode of energy transport, it can be significantly improved through the use of nucleate boiling. In order to achieve nucleate boiling of a coolant, the volumetric flow rate of the coolant must be significantly lower than in normal cooling systems known to those skilled in the art. In an outboard motor, the weight and fuel economy represent significant customer satisfaction parameters.

FIG. 1 is a graphical representation of a heating curve which shows the heat absorbed by water as it increases, or decreases, in temperature. In the portion of the curve between −50 degrees centigrade and 0 degrees centigrade, identified by reference numeral 10 in FIG. 1, the temperature of ice is increased, but remains in a solid form. In the portion of the curve identified by reference numeral 12, the ice absorbs a significant amount of heat as it changes from a solid to a liquid. After it converts to a liquid, as represented by the portion 14 of the curve, its temperature rises as the liquid absorbs heat until it reaches its boiling temperature of 100 degrees centigrade. The water then absorbs a significant amount of heat, as represented by curve portion 16, as it boils and absorbs latent heat of vaporization to convert the water to steam. Line portion 18 represents the absorption of heat by the steam which further increases its temperature. The simplified heating curve in FIG. 1 illustrates the significant amount of heat that is absorbed as the liquid converts to a gaseous form which is represented by the line segment 16. FIG. 1 shows the potential advantage to the cooling system if nucleate boiling can be properly harnessed to efficiently remove heat from a heat emitting component.

Figure 2:
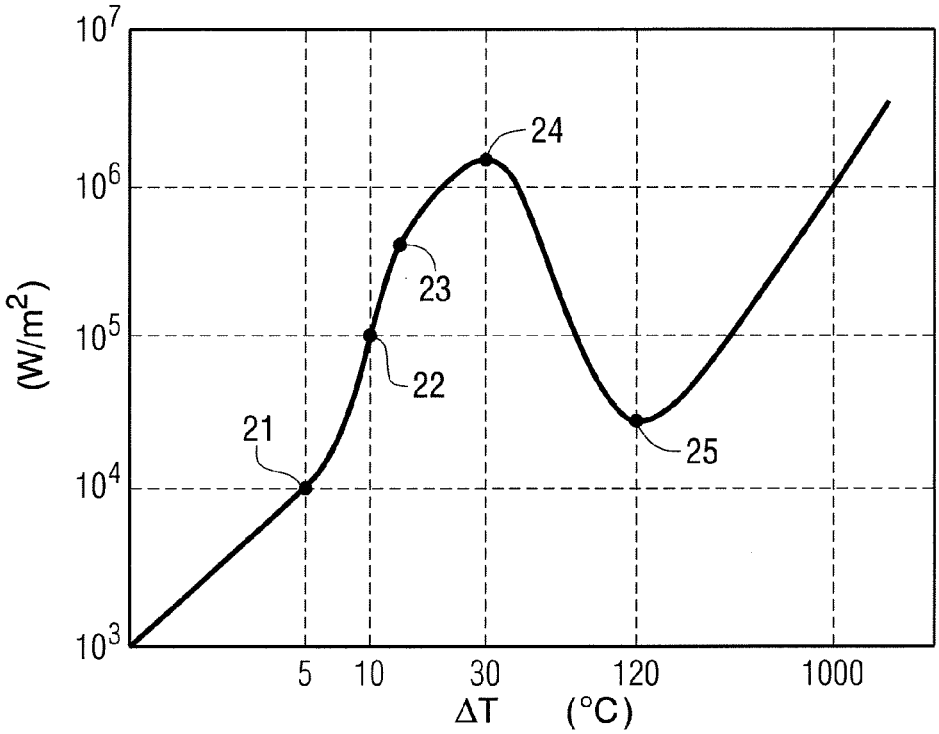
FIG. 2 is a boiling curve showing various heat flux regimes as a function of differential temperature of the liquid.

FIG. 2 is a typical boiling curve for water at a pressure of one atmosphere. The vertical axis represents surface heat flux and it is illustrated as a function of the excess temperature $\Delta T$ which is defined as the temperature above the saturation temperature of the liquid. Several different boiling regimes are shown in FIG. 2. At temperature differentials, $\Delta T$, less than approximately 5 degrees centigrade, free convection boiling exists. Typically, in this regime, up to the point identified by reference numeral 21, there is insufficient vapor in contact with the liquid phase of the water to cause boiling at the saturation temperature. As the temperature increases, bubble inception will eventually occur. However, at temperature differentials to the left of point 21 fluid motion is determined principally by free convection effects. Point 21 in FIG. 2 can generally be considered the onset of nucleate boiling. In the range between points 21 and 24, at differential temperatures between approximately 5 degrees centigrade and 30 degrees centigrade, nucleate boiling occurs. In this range, two different flow regimes may be observed. Between points 21 and 22, isolated bubbles form at nucleation sites and separate from the surface. This separation induces considerable fluid mixing near the surface. In this regime, most of the heat exchange is through direct transfer from the surface liquid in motion at the surface and not through the vapor bubbles rising from the surface. As the temperature increases beyond point 22, more nucleation sites become active and increased bubble formation causes bubble interference and coalescence. In the region between points 22 and 24, the vapor escapes as jets or columns which subsequently merge into regions of vapor. Interference between the densely populated bubbles inhibits the motion of liquid near the surface. Point 23 in FIG. 2 corresponds to an inflection point in the boiling curve at which the heat transfer coefficient is at a maximum value. At this point, the change in heat flux as a function of differential temperature continues to increase. This trend occurs because the relative increase in differential temperature exceeds the relative reduction in heat flux. However, at point 24, further increases in differential temperature are balanced by reductions in the heat flux. Point 24 is often referred to as the critical heat flux and, in water at atmospheric pressure, it generally exceeds 1.0 $MW/m^2$. At the point of this maximum magnitude, considerable vapor is being formed, making it difficult for liquid to continuously wet the surface of the heat emitting object.

With continued reference to FIG. 2, between points 24 and 25, transition boiling, unstable film boiling, or partial film boiling occurs. Point 25 is generally equal to a differential temperature of approximately 120 degrees centigrade.

With continued reference to FIG. 2, one goal of a preferred embodiment of the present invention is to maintain the temperature of a coolant, in a closed cooling portion of the cooling system, at a differential temperature between points is 21 and 24. In this region of nucleate boiling, the efficiency of the heat removal from the heat emitting object, such as an engine, is significantly enhanced. Furthermore, the pumping requirements of the cooling system compared to a totally convention cooling arrangement, are significantly reduced.

Figure 3:
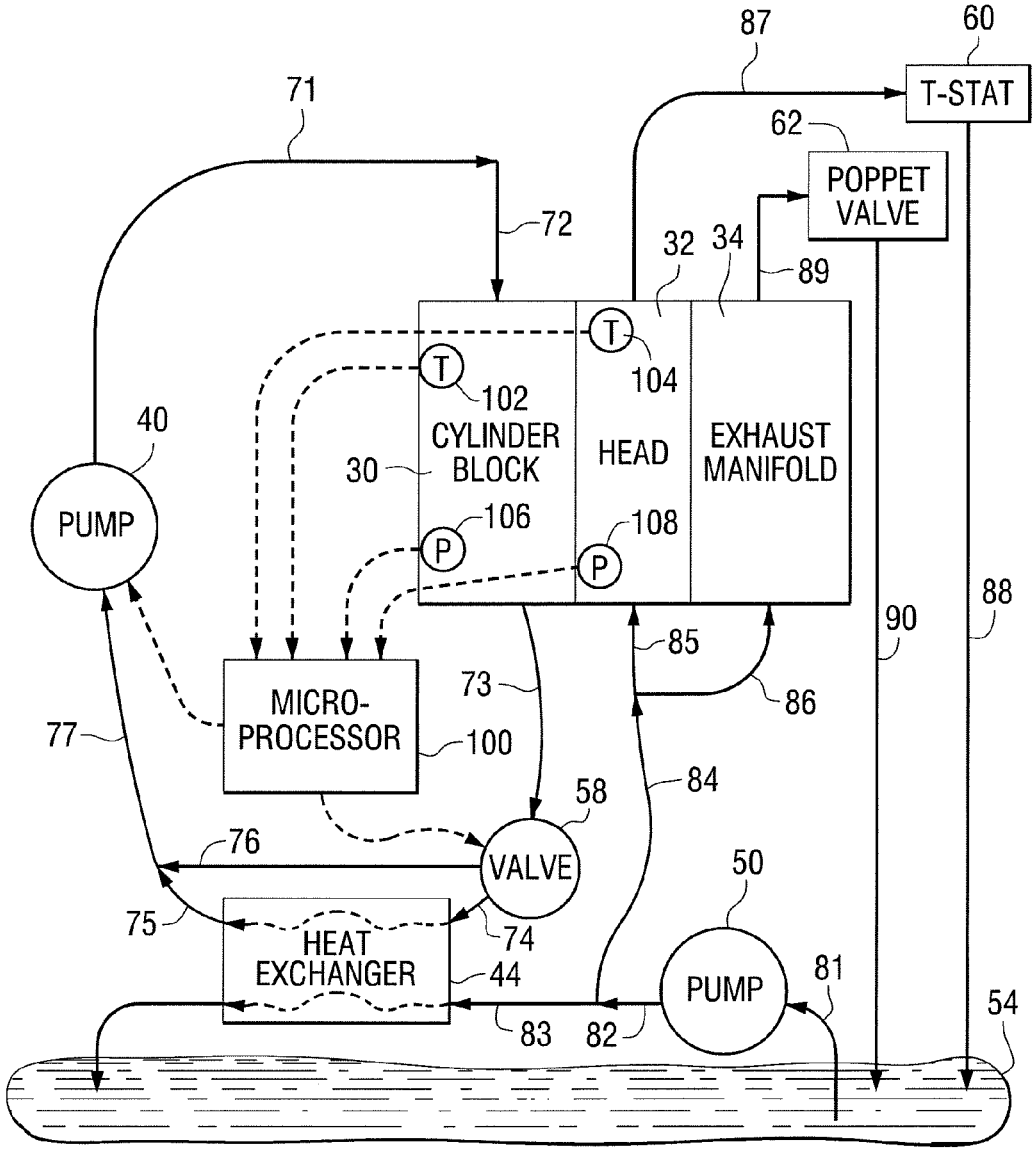
FIGS. 3 and 4 show two functional block diagrams of alternative embodiments of the present invention.

FIG. 3 is a highly simplified functional block diagram illustrating a marine propulsion cooling system that is suitable for performing the steps in a preferred embodiment of the present invention. An engine comprises a cylinder block 30 and a head portion 32. An exhaust manifold 34 is also shown in FIG. 3. A pump 40 circulates a coolant through a cooling jacket (not specifically illustrated in FIG. 3) within the engine. Those skilled in the art of marine propulsion systems are familiar with various types of cooling jackets that can be formed within the integral structure of the engine. The heat exchanger 44 is provided to remove heat from the coolant. The heat exchanger 44, in a preferred embodiment of the present invention, is a liquid-to-liquid heat exchanger. A sea pump 50 is used to draw water from a body of water 54 and circulate that water through the heat exchanger 44 in thermal communication with the coolant. This water, after passing through the heat exchanger 44, is then returned to the body of water 54.

With continued reference to FIG. 3, it should be noted that the cooling system of the marine propulsion device contains both a closed portion and an open portion. The closed portion, which circulates a coolant therethrough, comprises the pump 40, the cooling jacket of the cylinder block 30, a valve 58, and the heat exchanger 44. The coolant flowing through the closed portion of the cooling system is typically a mixture of water and an additive, such as ethylene glycol or some other liquid, which performs an advantageous function such as inhibiting corrosion or lowering the freezing point of the coolant. The valve 58 performs an important function in certain embodiments of the present invention. Water flowing from the cylinder block can be alternatively directed to flow through the heat exchanger 44 or directly to the inlet of the pump 40. This will be described in greater detail below. The open portion of the cooling system comprises the sea pump 50 and water jackets of both the head 32 and exhaust manifold 34. This open system also can incorporate a thermostat 60 and a poppet valve 62. Those skilled in the art of marine propulsion systems and cooling systems for the marine propulsion devices are familiar with the use of both the thermostat 60 and poppet valve 62. After passing through the head 32 and exhaust manifold 34, the water is returned to the body of water 54.

With reference to the closed portion of the cooling circuit shown in FIG. 3, the coolant is induced to flow, by the pump 40, along the paths identified by reference numerals 71 and 72. The coolant then passes through the cooling jacket of the cylinder block 30 and, along path 73 to the valve 58. Depending on the particular position of the valve 58, the water can be directed to flow through the heat exchanger along path 74 and then along path 75 or, alternatively, the coolant can be caused to bypass the heat exchanger 44 by the valve 58 and to flow along path 76. The coolant then flows along path 77 back to the pump 40. In a preferred embodiment of the present invention, the pump 40 is an electric pump and a variable speed pump.

With reference to the open portion of the cooling system shown in FIG. 3, water is drawn along path 81 by the sea pump 50 and directed to flow along path 82 to both the heat exchanger 44 (along path 83) and to both the head 32 and exhaust manifold 34 as represented by paths 84, 85, and 86. After absorbing heat from the head 32, the water continues to flow along path 87 to the thermostat 60 and, eventually, along path 88 back to the body of water 54. Water passing through the exhaust manifold 34 then flows along path 89 to the poppet valve 62 and back to the body of water along path 90.

A microprocessor 100 is configured to receive information from temperature sensors 102 and 104 and from pressure sensors 106 and 108. This information allows the microprocessor 100 to appropriately control the operation of the pump 40 and the valve 58 to maintain nucleate boiling.

With reference to FIGS. 2 and 3, it can be seen that the pump 40 and valve 58 can be used to maintain the differential temperature of the coolant in the closed portion of the cooling circuit between the temperatures represented by points 21 and 24. As an example, when the differential temperature of the coolant is below point 21 in FIG. 2, the pump 40 can be caused to operate at its lowest speed in order to slow the flow of coolant through the cylinder block 30. In addition, the valve 58 can be caused to bypass the flow of coolant around the heat exchanger and, instead, to flow along path 76 and 77 back to the pump 40. These actions will allow the coolant to increase in temperature until it reaches that represented by point 21. As the engine continues to operate, and the temperature of the coolant increases, the operating speed of the pump 40 can be slowly increased in order to maintain the differential temperature of the coolant between points 21 and 24. In certain embodiments of the present invention, a mid-point between points 21 and 24 can be used as a target magnitude. Above that target magnitude, the pump speed can be increased while below that target magnitude can be decreased. In order to maintain the differential temperature of the coolant at desired levels within the nucleate boiling regime, the valve 58 can be used in combination with the pump 40. By directing the flow of water along path 74 and 75, additional heat can be removed from the coolant. This step can be advantageous when the differential temperature of the coolant approaches the critical temperature 24. When the differential temperature is in the lower portion of the nucleate boiling regime, the valve 58 can be used to bypass the heat exchanger 44 and raise the temperature of the coolant.

FIG. 2 relates to the behavior of water at atmospheric pressure. Those skilled in the art will appreciate that different pressures and different liquids will affect this behavior. A matrix can be empirically determined to identify the regions of nucleate boiling, as a function of pressure for the coolant mixture being used.

Figure 4:
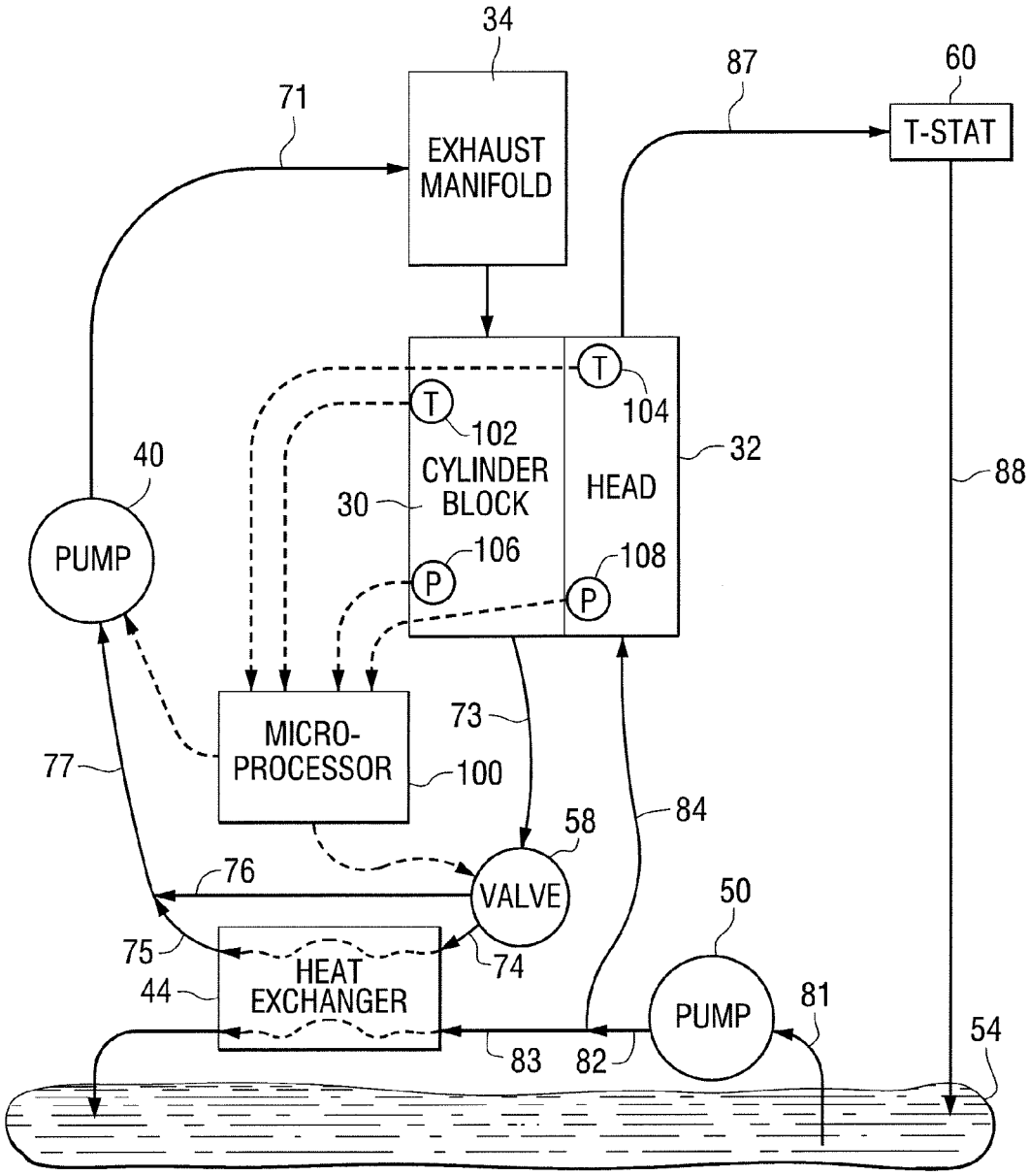

FIG. 4 is generally similar to FIG. 3, but with the exhaust manifold 34 included within the closed portion of the cooling system. With continued reference to FIGS. 3 and 4, it should be understood that the dashed line arrows associated with the microprocessor 100 represent the connection, in signal communication, between various components. In other words, the dashed line arrows extending from the temperature sensors 102 and 104 and pressure sensors 106 and 108 represent the fact that information from those sensors is provided to the microprocessor 100. In addition, the dashed line arrows extending from the microprocessor 100 to the valve 58 and pump 40 represent control signals by which the microprocessor 100 changes the operating condition of those components. The dashed lines arrows within the heat exchanger 44 represent the passage of water from the body of water in which the system is operated and the passage of coolant of the closed portion of the cooling system. These liquids pass in thermal communication with each other within the structure of the heat exchanger 44 which, as described above, is preferably a water-to-water heat exchanger.

Figure 5:
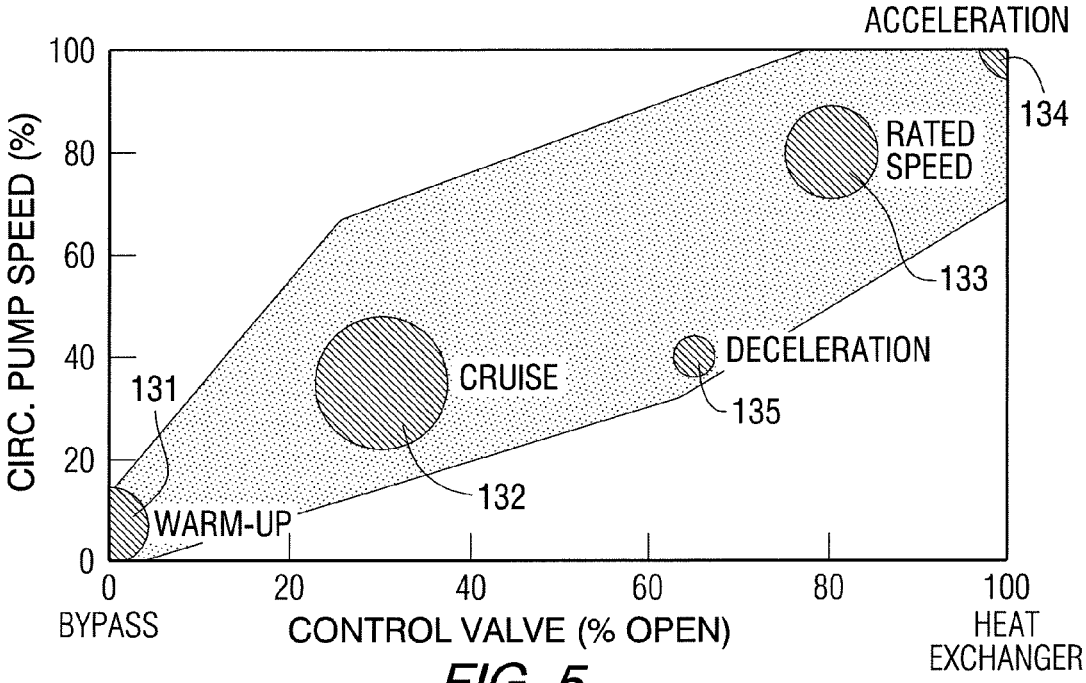
FIG. 5 is a graphical illustration showing the relationship between pump speed and bypass valve position under various operating conditions of a marine engine.

FIG. 5 is a graphical representation showing a typical exemplary relationship between the operating speed of the pump 40 and the operating position of the valve 58 which are described above in conjunction with FIGS. 3 and 4. Although it should be understood that various alternative operational relationships between the pump 40 and valve 58 can accomplish similar purposes, the graphical representation in FIG. 5 is intended to show an exemplary relationship under various operating conditions of the marine propulsion system.

With reference to FIGS. 3-5, warm up conditions of the engine would typically incorporate a position of the control valve 58 that bypassed the vast majority of the flow of coolant through flow path 76, with very little coolant passing through flow paths 74 and 75 and the heat exchanger 44. Under this warm up condition, when the operating temperature of the engine is typically below point 21 in FIG. 2, the circulation pump 44 would be operated at relatively low speeds. As a result, the circulation of the coolant through the cylinder block 30 and its cooling jacket would be very low. This allows the differential temperature shown in FIG. 2 to increase up to and beyond point 21. Since the valve 58 is in a bypass position and the pump is operating slowly, the slow moving coolant will basically retain most of the heat it absorbs from the cylinder block 30 as it passes slowly through the closed portion of the cooling circuit. The warm up condition is represented by area 131. During the operation of the engine at cruising speeds, which are represented by area 132 in FIG. 5, the circulation pump would typically operate at approximately 40% of its maximum speed and the control valve would bypass approximately 70% of its flow around the heat exchanger 44. At rated speed 133, when the engine is generating significant amounts of heat, the circulation pump speed is increased to approximately 80% and the control valve directs approximately 80% of the coolant flow through the heat exchanger 44. When accelerating at a high rate, as represented by region 134, the pump 40 can be operated at maximum speed and all of the flow can be directed through the heat exchanger 44 by the valve 58. The area 135, representing deceleration of the engine, can result in the circulation pump being operated at approximately 40% of its maximum speed with approximately 60-65% of the coolant flow being directed through the heat exchanger 44.

With continued reference to FIGS. 2-5, it should be recognized that the methodology which is graphically represented in FIG. 5 is provided to illustrate a hypothetical operation and is not limiting to the various embodiments of the present invention. In addition, the graph in FIG. 5 is not intended as a plan of action or a plan of operation of the present invention. Instead, it is provided to show a likely result when the microprocessor 100 follows various algorithms in order to maintain the differential temperature within a preselected range of the nucleate boiling regime. It should also be understood that various embodiments of the present invention can also incorporate a signal input which represents engine speed. This could help in anticipating an impending rapid rise in differential temperature when a sudden acceleration command is provided by the operator of the marine vessel. Under these conditions, the microprocessor 100 can be programmed to realize that a sudden acceleration command will result in a future increase in engine temperature even though the current temperature has not yet risen to excessive levels. For example, if the differential temperature is between points 22 and 23 in FIG. 2, and the operator commands a sudden increase in speed, the microprocessor can predict with sufficient confidence, that the differential temperature of the coolant will rise toward the critical temperature 24 in the near future. Under those conditions, the operating speed of the pump 40 and the position of the valve 58 can be changed accordingly even though the instantaneous differential temperature is still in the central portion of the nucleate boiling regime.

With continued reference to FIGS. 2-5, in a preferred embodiment of the present invention, at idle speed and during fast warm up operations, the pump 40 can be operated at a minimum speed to provide minimum volumetric coolant flow through the closed portion of the cooling system and the control valve 58 can be set to completely bypass the heat exchanger 44. At rated speed, or wide open throttle operation, the pump 40 can be operated at an optimized speed in order to provide coolant flow at a rate which facilitates the maintenance of the differential temperature within the nucleate boiling regime and the control valve 58 can be allowed to throttle the coolant flow through the heat exchanger at approximately an 80% rate. During transient operation modes, such as the acceleration to rated speed or wide open throttle operation, the pump 40 can be operated at maximum speed to provide sufficient cooling flow to handle sudden increases in thermal load to the cooling system and the control valve 58 can be operated to allow full coolant flow through the heat exchanger. When the system is decelerated to idle speed, the pump 40 can be set to cause substantial coolant to flow through the engine until the heat soaked energy is dissipated and the valve 58 can be set to allow sufficient flow through the heat exchanger to facilitate the dissipation of the heat soaked energy. It should be realized that during deceleration, the engine will continue to generate heat for some time after it has reduced its operational speed from a higher magnitude. This is also true after the engine is turned off. Heat within the body and structure of the engine will continue to be emitted after the engine is no longer running. During this period of time, the pump 40 and valve 44 can continue to operate in order to reduce the stored heat of the engine and remove that heat.

The present invention provides a method which uses nucleate boiling of a coolant to enhance the heat transfer to the coolant which is used to remove heat from the cylinder block water jacket and, in certain embodiments, the exhaust manifold. The cylinder head water jacket typically requires a low operating temperature in order to be less sensitive to knock. Furthermore, portions of the cooling system utilizing nucleate boiling must be in a closed loop portion of the cooling system. This is typically necessary to prevent mineral dissolution and the formation of scale which would otherwise occur if water from the body of water was allowed to experience nucleate boiling. The intended function of the present invention is to provide nucleate boiling within a closed portion of a cooling system of a marine propulsion device which also incorporates an open portion which passes water from a body of water through portions of the marine propulsion system and then returns that water to the body of water.

The low volumetric flow rate used in a system such as the present invention, which encourages nucleate boiling, allows an electric circulation pump to be used with power requirements within the range of a 12-volt marine system. This makes a closed loop cooling circuit possible for outboard engines. Without the use of nucleate boiling, the pump would have to be much larger. The resulting downsized cooling system can yield significant weight savings and improved fuel economy. Advantages can also be realized in the control of carbon monoxide and hydrocarbon emissions.

Although the present invention has been described with particular detail and illustrated to specifically show preferred embodiments of the present invention, it should be understood that alternative embodiments are also within its scope.

I claim:

1. A method for cooling a marine propulsion system, comprising the steps of:

providing an engine of said marine propulsion system;

directing water, from a body of water, to flow in thermal communication with at least one component of said marine propulsion system;

causing a coolant to flow in thermal communication with said engine;

providing a heat exchanger to remove heat from said coolant, said heat exchanger being a liquid-to-liquid heat exchanger;

and controlling the flow of said coolant to cause said coolant to experience nucleate boiling when the temperature of said coolant is above a saturation point of said coolant.

2. The method of claim 1, wherein:

said controlling step comprises the steps of increasing the rate of said flow when said temperature of said coolant is greater than a critical temperature of said coolant and decreasing said rate of said flow when said temperature of said coolant is less than a saturation temperature of said coolant.

3. The method of claim 1, wherein:

said controlling step comprises the steps of increasing the removal of heat from said coolant by said heat exchanger when said temperature of said coolant is greater than a critical temperature of said coolant and decreasing said removal of heat from said coolant by said heat exchanger when said temperature of said coolant is less than a saturation temperature of said coolant.

4. The method of claim 3, further comprising:

providing a valve connected in fluid communication between said engine and said heat exchanger.

5. The method of claim 4, wherein:

said controlling step comprises the steps of causing said valve to direct said flow of coolant through said heat exchanger when said temperature of said coolant is greater than a critical temperature of said coolant and causing said valve to bypass said heat exchanger when said temperature of said coolant is less than a saturation temperature of said coolant.

6. The method of claim 5, wherein:

said coolant circulates through a closed cooling system comprising a cooling jacket of said engine, a pump, said valve, and said heat exchanger.

7. The method of claim 6, wherein:

said closed cooling system, comprises an exhaust manifold of said engine.

8. The method of claim 6, wherein:

said pump is an electrical pump.

9. The method of claim 6, wherein:

said pump is a variable speed pump.

10. A method for cooling a marine propulsion system, comprising the steps of:

providing an engine with a cooling jacket disposed in thermal communication with said engine;

directing water, from a body of water, to flow in thermal communication with at least one component of said marine propulsion system;

connecting a pump in fluid communication with said cooling jacket, said pump being configured to cause a coolant to flow through said cooling jacket in thermal communication with said engine;

measuring a temperature of said coolant;

determining an effective pressure of said coolant;

controlling the flow of said coolant to cause said coolant to experience nucleate boiling when the temperature of said coolant is above a saturation point of said coolant;

providing a heat exchanger, connected in fluid communication with said cooling jacket, to remove heat from said coolant, said heat exchanger being a liquid-to-liquid heat exchanger; and providing a valve connected in fluid communication with said heat exchanger, said valve being configured to alternatively direct said flow of said coolant through said heat exchanger and to cause said flow of said coolant to bypass said heat exchanger, said controlling step comprising the steps of increasing the removal of heat from said coolant by said heat exchanger when said temperature of said coolant is greater than a critical temperature of said coolant and decreasing said removal of heat from said coolant by said heat exchanger when said temperature of said coolant is less than a saturation temperature of said coolant.

11. The method of claim 10, further comprising:

determining said saturation temperature of said coolant as a function of said effective pressure.

12. The method of claim 11, further comprising:

determining a critical temperature of said coolant as a function of said effective pressure.

13. The method of claim 12, wherein:

said controlling step comprises the steps of increasing the operating speed of said pump to increase said flow when said temperature of said coolant is greater than a critical temperature of said coolant and decreasing the operating speed of said pump to decrease said flow when said temperature of said coolant is less than a saturation temperature of said coolant.

14. The method of claim 13, wherein:

said coolant circulates through a closed cooling system comprising a cooling jacket of said engine, a pump, said valve, and said heat exchanger.

15. The method of claim 14, wherein:

said closed cooling system, comprises an exhaust manifold of said engine.

16. The method of claim 10, wherein:

said pump is an electrical pump.

17. The method of claim 10, wherein:

said pump is a variable speed pump.

18. A method for cooling a marine propulsion system, comprising the steps of:

providing an engine with a cooling jacket disposed in thermal communication with said engine;

directing water, from a body of water, to flow in thermal communication with at least one component of said marine propulsion system;

connecting a pump in fluid communication with said cooling jacket, said pump being configured to cause a coolant to flow through said cooling jacket in thermal communication with said engine;

measuring a temperature of said coolant;

determining an effective pressure of said coolant;

controlling the flow of said coolant to cause said coolant to experience nucleate boiling when the temperature of said coolant is above a saturation point of said coolant;

determining said saturation temperature of said coolant as a function of said effective pressure;

determining a critical temperature of said coolant as a function of said effective pressure, said controlling step comprising the steps of increasing the operating speed of said pump to increase said flow when said temperature of said coolant is greater than a critical temperature of said coolant and decreasing the operating speed of said pump to decrease said flow when said temperature of said coolant is less than a saturation temperature of said coolant;

providing a heat exchanger, connected in fluid communication with said cooling jacket, to remove heat from said coolant, said heat exchanger being a liquid-to-liquid heat exchanger; and providing a valve connected in fluid communication with said heat exchanger, said valve being configured to alternatively direct said flow of said coolant through said heat exchanger and to cause said flow of said coolant to bypass said heat exchanger, said controlling step comprising the steps of increasing the removal of heat from said coolant by said heat exchanger when said temperature of said coolant is greater than a critical temperature of said coolant and decreasing said removal of heat from said coolant by said heat exchanger when said temperature of said coolant is less than a saturation temperature of said coolant.

19. The method of claim 18, wherein:

said coolant circulates through a closed cooling system comprising a cooling jacket of said engine, a pump, said valve, and said heat exchanger.

20. The method of claim 19, wherein:

said closed cooling system, comprises an exhaust manifold of said engine.

21. The method of claim 18, wherein:

said pump is an electrical pump.

22. The method of claim 18, wherein:

said pump is a variable speed pump.

* * * * *